US011189179B2

(12) United States Patent
Chauvet

(10) Patent No.: US 11,189,179 B2
(45) Date of Patent: Nov. 30, 2021

(54) METHOD FOR REVISING A TARGET TAKE OFF TIME IN THE ENVIRONMENT OF AN AIRPORT, ASSOCIATED SYSTEM AND AIRCRAFT COMPRISING SUCH A SYSTEM

(71) Applicant: Airbus (S.A.S.), Blagnac (FR)

(72) Inventor: Olivier Chauvet, Colomiers (FR)

(73) Assignee: Airbus (S.A.S.), Blagnac (FR)

( * ) Notice: Subject to any disclaimer, the term of this patent is extended or adjusted under 35 U.S.C. 154(b) by 190 days.

(21) Appl. No.: 16/655,607

(22) Filed: Oct. 17, 2019

(65) Prior Publication Data

US 2020/0126433 A1 Apr. 23, 2020

(30) Foreign Application Priority Data

Oct. 19, 2018 (FR) ..... 1871235

(51) Int. Cl.
*G08G 5/00* (2006.01)

(52) U.S. Cl.
CPC ..... *G08G 5/0043* (2013.01); *G08G 5/0013* (2013.01); *G08G 5/0021* (2013.01)

(58) Field of Classification Search
CPC .. G08G 5/0043; G08G 5/0013; G08G 5/0021; G08G 5/065; G08G 5/0065
See application file for complete search history.

(56) References Cited

U.S. PATENT DOCUMENTS

2015/0154874 A1* 6/2015 Murthy ..... G08G 5/06 701/120
2015/0298817 A1 10/2015 Jackson et al.
2018/0218615 A1* 8/2018 Myr ..... G08G 5/045

FOREIGN PATENT DOCUMENTS

FR 2 954 565 A1 6/2011

OTHER PUBLICATIONS

French Search Report for Application No. 1871235 dated Jun. 27, 2019.

* cited by examiner

*Primary Examiner* — Thomas G Black
*Assistant Examiner* — Ana D Thomas
(74) *Attorney, Agent, or Firm* — Jenkins, Wilson, Taylor & Hunt, P.A.

(57) ABSTRACT

A method for revising a target take off time in the environment of an airport, associated system and aircraft having such a system. The method includes steps implemented by a computer of an aircraft, including acquisition from an information source of a current position of the aircraft in the environment of the airport and determination of a revised take off time from the current position of the aircraft, from airport data and from performance data of the aircraft, comparison of the target take off time, previously stored in a data memory of the aircraft, to the revised take off time, and if the difference between the target take off time and the revised take off time is greater than a tolerance value, sending by a communication unit of the aircraft of the revised take off time to a system external to the aircraft.

15 Claims, 1 Drawing Sheet

METHOD FOR REVISING A TARGET TAKE OFF TIME IN THE ENVIRONMENT OF AN AIRPORT, ASSOCIATED SYSTEM AND AIRCRAFT COMPRISING SUCH A SYSTEM

CROSS-REFERENCE TO RELATED APPLICATION

This application claims priority to French patent application number 18 712235 filed on Oct. 19, 2018, the entire disclosure of which is incorporated by reference herein.

TECHNICAL FIELD

The disclosure herein relates to a method for revising a target take off time of an aircraft in the environment of an airport, a system for revising a target take-off time of an aircraft in the environment of an airport and an aircraft comprising such a system.

BACKGROUND

In order to regulate the ground traffic of an airport, the aircraft are assigned, from their flight plan, a target take off time defined by a departure management tool, or a departure manager ("Departure MANager tool") specific to the airport. Each target take off time is transmitted to the aircraft concerned via radiofrequency communications. From this target take off time, an estimated taxiing time to the take off runway and the number of aircraft expected at the take off runway, the departure manager determines and sends to the aircraft a planned starting time from its parking area ("Target Off Block Time"). Since the aircraft is parked on a parking area at a gate of the airport, a pushback maneuver is necessary to leave the gate. This maneuver consists in moving the aircraft by a tractor in order to move it back from the gate and bring it into a position in which it can advance autonomously in order to join the take off runway. When the aircraft is ready for the pushback, it informs the departure manager thereof and then awaits reception of a pushback clearance.

Once the pushback clearance has been received, the aircraft is pushed back by a pushback vehicle or a towing vehicle, in particular a tractor, until it leaves its parking area and is located on the taxiways of the airport. Then, the aircraft switches on at least one of its engines and taxis to the take off runway. The aircraft can arrive early or late at the take off runway. For example, the pushback may take longer than planned or the taxiing time may be prolonged according to weather conditions. Furthermore, the speed of the aircraft can vary, in particular according to the effective weight of the aircraft, the architecture of the taxiways of the airport and in particular the angle of the turns, the behavior of the pilot, etc.

Thus, if the aircraft does not reach the take off runway at the target take off time, the airport traffic may be disrupted and become congested. This disruption may have repercussions on the air traffic and have consequences on the traffic of neighboring airports.

SUMMARY

An aim of the disclosure herein is in particular to provide a solution to this problem. It relates to a method for revising a target take off time of an aircraft in the environment of an airport.

This method is implemented by a computer of the aircraft cooperating with a data memory provided to store a target take off time. The computer cooperates also with:

- at least one information source configured to determine a position of the aircraft in the environment of the airport; and
- a communication unit configured to establish radiofrequency communications between the aircraft and systems external to the aircraft.

The method iteratively comprises the following steps implemented by the computer:

- acquisition, from the information source, of a current position of the aircraft in the environment of the airport and determination of a revised take off time from the current position of the aircraft, airport data and performance data of the aircraft;
- comparison of a target take off time, previously stored in the data memory, with the revised take off time; and
- if the difference between the target take off time and the revised take off time is greater than a tolerance value, sending by the communication unit of the revised take off time to a system external to the aircraft.

Thus, a system external to the aircraft, such as a departure manager, is informed of any modification of the target take off time of the aircraft once the latter has received a pushback clearance, which allows for a better management of the airport traffic and of the air traffic. The revised target take off time takes account of the actual conditions of operation of the aircraft, by using the performance data of the aircraft, and the real conditions of movement of the aircraft over the airport domain, by using the airport data. This makes it possible to determine a target take off time that is more accurate than that estimated by the departure manager.

According to different embodiments that can be combined with one another:

- the external system is a departure manager;
- the performance data of the aircraft comprise the weight of the aircraft, the value of the acceleration and/or the deceleration of the aircraft as a function of the value of the thrust of the engines and/or of the operational rules of the aircraft;
- the performance data of the aircraft are updated according to the weather conditions;
- the computer determines the revised take off time, also, from a pushback clearance time transmitted by the departure manager;
- the tolerance value is equal to thirty seconds;
- the airport data comprise a take off runway identifier and a taxiing route.

The disclosure herein also relates to a system for revising a target take-off time of an aircraft in the environment of an airport, the system comprising a computer of the aircraft and a data memory provided to store a target take off time. The system comprises:

- a communication unit configured to establish radiofrequency communications between the aircraft and systems external to the aircraft; and
- at least one information source configured to determine a position of the aircraft in the environment of the airport.

The computer is configured to:

- acquire from the information source a current position of the aircraft in the environment of the airport and determine a revised take off time from the current position of the aircraft, airport data and performance data of the aircraft;

compare a target take off time, previously stored in the data memory, with the revised take off time; and if the difference between the target take off time and the revised take off time is greater than a tolerance value, command the sending by the communication unit of the revised take-off time to a system external to the aircraft.

According to different embodiments that can be combined with one another:

the system external to the aircraft is a departure manager;

the performance data of the aircraft comprise the weight of the aircraft, the value of the acceleration and/or of the deceleration of the aircraft as a function of the value of the thrust of the engines and/or of the operational rules of the aircraft;

the performance data of the aircraft are updated according to the weather conditions;

the computer is configured to determine the revised take off time, also, from a pushback clearance time transmitted by the departure manager;

the tolerance value is equal to thirty seconds;

the airport data comprise a take off runway identifier and a taxiing route.

The disclosure herein also relates to an aircraft comprising a system or revising a target take off time as specified above.

BRIEF DESCRIPTION OF DRAWINGS

Other performance data, details and advantages of the disclosure herein will emerge more clearly from the detailed description given hereinbelow by way of indication in relation to the example drawings in which.

DETAILED DESCRIPTION

Figure 1:
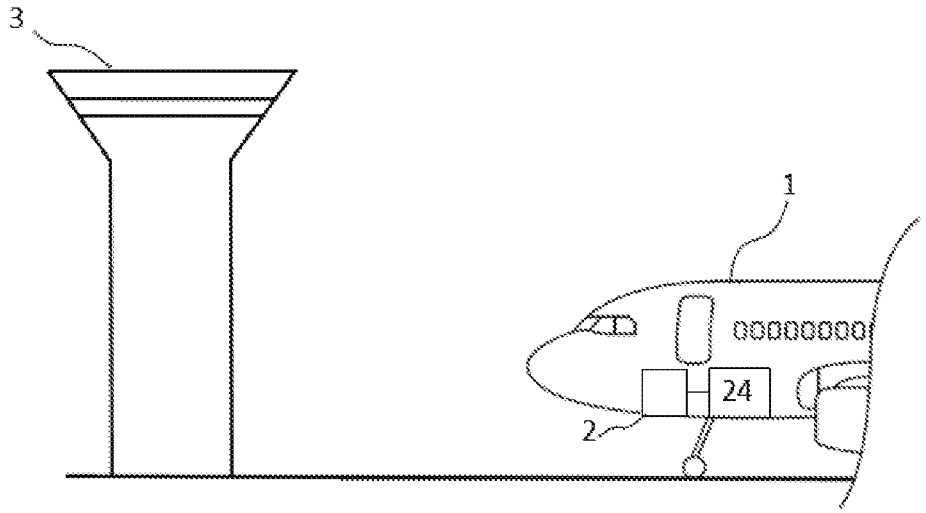
FIG. 1 is a schematic view of an aircraft in the environment of an airport.

The aircraft 1, represented in FIG. 1, comprises a system 2 for revising a target take-off time TTOT in an environment of an airport. The aircraft 1 comprises a communication unit 24 configured to establish radiofrequency communications between the aircraft 1 and systems 3 external to the aircraft 1. An external system 3 is, for example, a departure manager DMAN.

Figure 2:
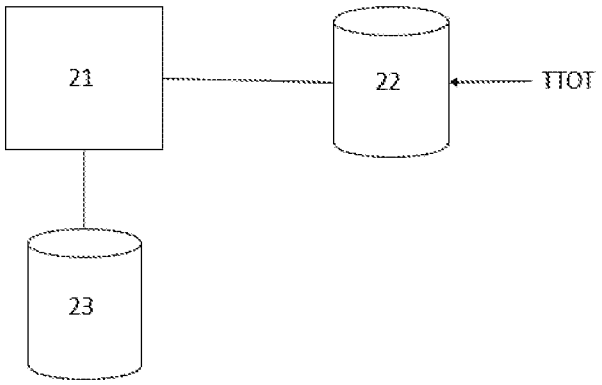
FIG. 2 represents a system for revising a target take-off time of the aircraft according to an embodiment of the disclosure herein.

The system 2 for revising a target take off time TTOT, represented in FIG. 2, comprises a computer 21 of the aircraft 1 linked to a data memory 22 provided to store a target take off time TTOT of the aircraft 1, and an information source 23 configured to determine the current position of the aircraft 1. In an embodiment, the information source 23 corresponds to a GNSS (acronym for "Global Navigation Satellite System") geolocation module. For example, such an information source is of GPS ("Global Positioning System") type.

The actual time of arrival of the aircraft 1 at its take off runway depends on the airport data and on the performance data of the aircraft 1. Indeed, the speed of the aircraft 1 is regulated by operational rules imposed by the aircraft constructors for each aircraft model. As an example, a given aircraft model can be authorized to taxi in a straight line at a maximum speed of the order of 25 to 35 knots, while when turning, this maximum speed is 10 knots. The estimated taxiing time to the take off runway can therefore vary from one aircraft model to another.

According to a first variant, the data memory 22 is provided to also store airport data and the performance data of the aircraft.

According to a second variant, the computer 21 is linked to a memory external to the system 2, the memory being configured to store the port data and the performance data of the aircraft.

By way example, the airport data are a digital representation of the environment of the airport, one or more take off runway identifiers and/or one or more taxiing routes, the geometry of the taxiways, etc.

By way of example, the performance data of the aircraft are the value of the acceleration and/or of the deceleration of the aircraft as a function of the value of the thrust of the engines, the operational rules of the aircraft, the weight of the aircraft, the engine specific performance data, etc.

In operation, the computer 21 receives from the departure manager DMAN the target take-off time TTOT and stores it in the data memory 22. Next, the computer 21 acquires from the information source 23 a current position of the aircraft 1 in the environment of the airport and determines a revised target take off time RTOT from the current position of the aircraft, the airport data and the performance data of the aircraft.

Once the revised target take off time RTOT value has been determined, the computer 21 compares it to the target take off time TTOT value. If the difference between the target take off time TTOT and the revised target take off time RTOT is greater than a tolerance value, the computer 21 sends the revised target take off time RTOT via the communication unit 24 to a system 3 external to the aircraft, such as a departure manager DMAN. The tolerance value is stored previously in the data memory 22. It is greater than or equal to thirty seconds.

Thus informed, the departure manager DMAN can organize the departure of other aircraft by taking into account the early or late arrival of the aircraft 1 at the take off runway. That makes it possible to make the airport traffic more fluid and improve the coordination with other airports.

For safety reasons, the performance data of the aircraft can depend on the weather conditions. Indeed, in case of rain or of wet taxiways, it may be necessary to reduce the authorized taxiing speed. The computer 21 is consequently configured to update the performance data of the aircraft according to the weather conditions and determine therefrom a new revised target take off time RTOT.

According to one embodiment, when the aircraft 1 is stopped on a parking area, the computer 21 is configured to determine the revised target take off time RTOT from the pushback clearance time transmitted by the departure manager. Thus, the aircraft 1 has the possibility of informing the departure manager of any delay on the target take off time TTOT before starting. The departure manager DMA can consequently take the decision to immobilize the aircraft at its parking area and recompute a target take off time, making it possible to not congest the airport traffic.

The computer 21 is configured to implement this method for revising a target take off time iteratively, for example every twenty seconds.

The disclosure herein thus makes it possible to improve the airport traffic and assist the departure manager DMAN. Furthermore, a better management of the airport traffic makes it possible to reduce the fuel consumption of the aircraft, the latter no longer being obliged to queue to take off and pointlessly consume fuel. The subject matter disclosed herein can be implemented in software in combination with hardware and/or firmware. For example, the subject matter described herein can be implemented in software executed by a processor or processing unit. In one exemplary implementation, the subject matter described herein can be implemented using a computer readable medium having stored thereon computer executable instructions that when executed by a processor of a computer control the computer to perform steps. Exemplary computer readable mediums suitable for implementing the subject matter described herein include non-transitory devices, such as disk memory devices, chip memory devices, programmable logic devices, and application specific integrated circuits. In addition, a computer readable medium that implements the subject matter described herein can be located on a single device or computing platform or can be distributed across multiple devices or computing platforms.

While at least one example embodiment of the invention (s) is disclosed herein, it should be understood that modifications, substitutions and alternatives may be apparent to one of ordinary skill in the art and can be made without departing from the scope of this disclosure. This disclosure is intended to cover any adaptations or variations of the example embodiment(s). In addition, in this disclosure, the terms "comprise" or "comprising" do not exclude other elements or steps, the terms "a", "an" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method for revising a target take off time of an aircraft in an environment of an airport, implemented by a computer of the aircraft cooperating with a data memory provided to store a target take off time, wherein the computer cooperates also with at least one information source configured to determine a position of the aircraft in the environment of the airport, and a communication unit configured to establish radiofrequency communications between the aircraft and systems external to the aircraft, the method iteratively comprising steps implemented by the computer of:

acquiring, from the information source, a current position of the aircraft in the environment of the airport and determining a revised take off time from the current position of the aircraft, from airport data and from aircraft performance data;

comparing a target take off time, previously stored in the data memory, with the revised take off time; and sending by the communication unit of the revised take off time to a system external to the aircraft when a difference between the target take off time and the revised take off time is greater than a tolerance value.

2. The method according to claim 1, wherein the external system is a departure manager.

3. The method according to claim 1, wherein the aircraft performance data comprises weight of the aircraft, value of acceleration as a function of a value of thrust of engines of the aircraft and/or of operational rules of the aircraft, and/or value of deceleration of the aircraft as a function of the value of thrust of engines of the aircraft and/or of the operational rules of the aircraft.

4. The method according to claim 1, wherein the aircraft performance data are updated according to weather conditions.

5. The method according to claim 1, wherein the computer determines the revised take off time, also, from a pushback clearance time transmitted by a departure manager.

6. The method according to claim 1, wherein the tolerance value is equal to thirty (30) seconds.

7. The method according to claim 1, wherein the airport data comprise a take off runway identifier and a taxiing route.

8. A system for revising a target take off time of an aircraft in an environment of an airport, the system comprising:

a data memory to store a target take off time;

a communication unit configured to establish radiofrequency communications between the aircraft and systems external to the aircraft;

at least one information source configured to determine a position of the aircraft in the environment of the airport; and a computer of the aircraft, which is configured to:

acquire from the information source a current position of the aircraft in the environment of the airport and determine a revised take off time from the current position of the aircraft, from airport data and from performance data of the aircraft;

compare a target take off time, previously stored in the data memory, with the revised take off time; and command sending by the communication unit of the revised take off time to a system external to the aircraft when a difference between the target take off time and the revised take off time is greater than a tolerance value.

9. The system for revising a target take off time of an aircraft according to claim 8, wherein the system external to the aircraft is a departure manager.

10. The system for revising a target take off time of an aircraft according to claim 8, wherein the performance data of the aircraft comprise weight of the aircraft, value of acceleration as a function of a value of thrust of engines of the aircraft and/or of operational rules of the aircraft, and/or value of deceleration of the aircraft as a function of the value of thrust of engines of the aircraft and/or of the operational rules of the aircraft.

11. The system for revising a target take off time of an aircraft according to claim 8, wherein the performance data of the aircraft are updated according to the weather conditions.

12. The system for revising a target take off time of an aircraft according to claim 8, wherein the computer is configured to determine the revised take off time, also, from a pushback clearance time transmitted by the departure manager.

13. The system for revising a target take off time of an aircraft according to claim 8, wherein the tolerance value is equal to thirty (30) seconds.

14. The system for revising a target take off time of an aircraft according to claim 8, wherein the airport data comprise a take off runway identifier and a taxiing route.

15. An aircraft comprising a system for revising a target take off time of an aircraft in an environment of an airport according to claim 8.

* * * * *